US006702646B1

(12) United States Patent
Gitis et al.

(10) Patent No.: US 6,702,646 B1
(45) Date of Patent: Mar. 9, 2004

(54) METHOD AND APPARATUS FOR MONITORING POLISHING PLATE CONDITION

(75) Inventors: Norm Gitis, Cupertino, CA (US); Aleksandr Meyman, Belmont, CA (US); Michael Vinogradov, Sunnyvale, CA (US); Mikhail Faynberg, San Jose, CA (US); Vlad Dorfman, Sunnyvale, CA (US)

(73) Assignee: Nevmet Corporation, Reno, NV (US)

( * ) Notice: Subject to any disclaimer, the term of this patent is extended or adjusted under 35 U.S.C. 154(b) by 0 days.

(21) Appl. No.: 10/184,369

(22) Filed: Jul. 1, 2002

(51) Int. Cl.[7] ..... B24B 51/00

(52) U.S. Cl. ..... 451/5; 451/8; 451/21; 451/56; 451/443

(58) Field of Search ..... 451/5, 6, 8, 9, 451/21, 56, 72, 443, 444

(56) References Cited

U.S. PATENT DOCUMENTS

| | | | | | |
|---|---|---|---|---|---|
| 5,222,329 | A | * | 6/1993 | Yu | 451/11 |
| 5,232,875 | A | | 8/1993 | Tuttle et al. | |
| 5,234,867 | A | | 8/1993 | Schultz et al. | |
| 5,439,551 | A | * | 8/1995 | Meikle et al. | 438/5 |
| 5,486,131 | A | | 1/1996 | Cesna et al. | |
| 5,597,341 | A | | 1/1997 | Kodera et al. | |
| 5,618,447 | A | | 4/1997 | Sandhu | |
| 5,650,619 | A | | 7/1997 | Hudson | |
| 5,664,987 | A | | 9/1997 | Renteln | |
| 5,738,562 | A | | 4/1998 | Doan et al. | |
| 5,743,784 | A | * | 4/1998 | Birang et al. | 451/21 |
| 5,825,028 | A | | 10/1998 | Hudson | |
| 5,834,645 | A | | 11/1998 | Bartels et al. | |
| 5,868,605 | A | | 2/1999 | Cesna | |
| 5,899,800 | A | | 5/1999 | Shendon | |
| 5,934,974 | A | * | 8/1999 | Tzeng | 451/6 |
| 5,941,761 | A | | 8/1999 | Nagahara et al. | |
| 5,948,205 | A | | 9/1999 | Kodera et al. | |
| 5,948,700 | A | | 9/1999 | Zheng et al. | |
| 5,951,370 | A | | 9/1999 | Cesna | |
| 5,974,679 | A | * | 11/1999 | Birang et al. | 33/553 |
| 5,975,994 | A | | 11/1999 | Sandhu et al. | |
| 6,040,244 | A | | 3/2000 | Arai et al. | |
| 6,045,434 | A | | 4/2000 | Fisher et al. | |
| 6,090,475 | A | | 7/2000 | Robinson et al. | |
| 6,093,080 | A | | 7/2000 | Inaba et al. | |
| 6,136,043 | A | | 10/2000 | Robinson et al. | |
| 6,184,139 | B1 | | 2/2001 | Adams et al. | |
| 6,194,231 | B1 | | 2/2001 | Ho-Cheng et al. | |
| 6,234,868 | B1 | | 5/2001 | Easter et al. | |
| 6,257,953 | B1 | | 7/2001 | Gitis et al. | |
| 6,354,910 | B1 | | 3/2002 | Adebanjo et al. | |
| 2002/0037681 | A1 | | 3/2002 | Gitis et al. | |

FOREIGN PATENT DOCUMENTS

| | | |
|---|---|---|
| WO | WO 01/15865 A1 | 3/2001 |

* cited by examiner

*Primary Examiner*—Lee D. Wilson
*Assistant Examiner*—Hadi Shakeri

(57) ABSTRACT

An apparatus for monitoring a condition of a polishing plate, in particular for detecting the time for the polishing plate to be reconditioned or replaced, comprising a measuring unit containing at least one sensing unit and a signal-conditioning unit; and a data processing unit. The measuring unit is being in contact with the polishing plate and having a possibility to move relative to it. The sensing unit comprises a probing tip and a set of sensors attached to the back surface of the probing tip, and contains at least one sensor of the group of coefficient of friction sensor, acoustic emission sensor, wear sensor. All sensors work simultaneously and their measurement data is processed and analyzed by a data processing unit for obtaining accurate and reliable results.

22 Claims, 9 Drawing Sheets

V-V

V-V

V-V

METHOD AND APPARATUS FOR MONITORING POLISHING PLATE CONDITION

FIELD OF THE INVENTION

The present invention relates to the field of polishing, in particular chemical mechanical polishing in the manufacture of semiconductor wafers and integrated circuits. More particularly, the invention relates to a method and apparatus for controlling chemical-mechanical polishing processes by monitoring the results and process of polishing plate wear and conditioning.

BACKGROUND OF THE INVENTION

Polishing processes play significant role in modern technologies, in particular in semiconductor fabrication. For example, at certain stages in the fabrication of devices on a substrate, it may become necessary to polish or planarize a surface of the substrate before further processing. Polishing may also be performed with chemically active abrasive slurry, such polishing is commonly known as a chemical mechanical polishing (also called chemical mechanical planarization, or just CMP). In a polishing process, a polishing plate repetitively passes over the surface of the substrate; abrasive particles are either present on the plate or supplied with the slurry. In contrast with mechanical polishing, the CMP slurry provides an increased removal rate of a substrate material and the capability to selectively polish certain films on the substrate.

Chemical mechanical planarization may be used as a preparation step in the fabrication of substrates or semiconductor wafers to provide substantially planar front and backsides thereon. CMP is also used to remove high elevation features and other discontinuities, created on the outermost surface of a substrate during fabrication of a microelectronic circuitry.

The planarization method typically requires that the substrate be mounted in a wafer head or carrier, with the substrate surface to be polished exposed. The substrate supported by the head is then placed against a moving polishing pad mounted on a platen. The head may also move, for example rotate, to provide additional motion between the substrate and the polishing pad. Polishing slurry is supplied onto the pad to provide an abrasive chemical solution at the interface between the pad and the substrate. Pressure is applied on the carrier to effectuate polishing. In some polishing machines the substrate rotates while the polishing pad is stationary, in others the pad moves while the wafer is stationary, and in yet another type both the wafer carrier and the pad move simultaneously. The polishing pad may be pre-soaked and continually re-wet with slurry.

DESCRIPTION OF THE RELATED ART

U.S. Pat. No. 5,597,341 issued on Jan. 28,1997 to Kodera, et al, U.S. Pat. No. 5,234,867 issued on Aug. 10, 1993 to Schultz, et al., and U.S. Pat. No. 5,232,875 issued on Aug. 3, 1993 to Tuttle, et al illustrate several techniques and corresponding types of CMP systems for chemical mechanical planarization of semiconductor wafer surfaces.

One type of CMP systems, used in the apparatuses of the type disclosed in the aforementioned references, is shown schematically in FIG. 1*a*. In this system a polishing pad 10*a* is mounted on a platen 12*a*, which rotates by means of a first motor 14*a* through a transmission 16*a*. A wafer 20*a* with a front surface 22*a* to be polished is held on a head 24*a*. In the illustrated apparatus, the polishing pad 10*a* has a diameter significantly larger than that of the wafer 20*a* (FIG. 1*a*). The polishing head 24*a* is rotated by means of a second motor 26*a* through a transmission 28*a* and comprises a retaining ring 30*a* which prevents the wafer from slipping out of the head during polishing. A slurry feeding system 32*a* pours slurry on the top working surface of the pad 10*a*.

FIG. 1*b* illustrates another embodiment of the aforementioned known CMP system. In this embodiment, a polishing pad 11*b* is mounted on a platen 12*b*, which is rotated by means of a first motor 14*b* through a transmission 16*b*. A wafer 20*b* with a front surface 22*b* to be polished is held on a head 24*b*. In the illustrated apparatus, the polishing pad 1*b* has a diameter significantly smaller than that of the wafer 20*b* (FIG. 1*b*). The polishing head 24*b* is rotated by means of a second motor 26*b* through a transmission 28*b* and comprises a retaining ring 30*b*, which prevents the wafer from slipping out of the head during polishing. A slurry feeding system 32*b* pours slurry on the front surface of the wafer 22*b*.

In order to provide uniformity of polishing, in the CMP systems of the types shown in FIGS. 1*a* and 1*b*, the distance between the polishing pad rotational axis and the wafer rotational axis is typically varied in an oscillatory manner. For this purpose, the substrate is repeatedly moved back and forth relative to the polishing pad. In FIGS. 1*a* and 1*b* the oscillatory movement is shown by arrows 25*a* and 25*b*, respectively. Another type of the CMP system, shown schematically in FIG. 2, is disclosed, e.g., in U.S. Pat. No. 5,899,800, issued on May 4, 1999 to Shendon and in U.S. Pat. No. 6,184,139, issued on Feb. 6, 2001 to Adams, et al. In the CMP apparatus of these patents, the lower head comprising a polishing pad 10*c* mounted on a platen 12*c* is driven into orbital movements by means of an orbital drive 34 with a motor 36, while the carrier 24*c* holding the wafer 20*c* rotates about its central axis by a motor 26*c* via a transmission 28*c*. The pad diameter is slightly larger than the diameter of the wafer 20*c*. Polishing slurry is introduced directly through the openings 38*a*, 38*b* . . . 38*n* in the polishing pad 10*c* with point-of-use mix, which may result in better wafer uniformity and reduced slurry consumption.

Important characteristics of a planarization process in semiconductor wafer fabrication are a wafer material removal rate and uniformity of material removal. There are several factors that may affect these parameters. Since various materials of the wafer, polishing pad, slurry, and retaining ring interact in a course of polishing, a combination of their characteristics and process parameters, such as compression force or pressure, speed, temperature, etc., can provide specific polishing characteristics Typically, the material combination is selected based on a trade off between the polishing rate, which determines in large part the throughput of wafers through the polishing apparatus, and the need to provide a particular desired finish and flatness on the surface of the wafer.

The efficiency of polishing greatly depends on the pad surface conditions and may reduce with time as a polishing pad is contaminated, its pores jammed with various waste, and worn out. Therefore in the course of polishing, the pad surface should be refreshed or "conditioned" after a period of use to provide for both a more uniform polishing rate from wafer to wafer and better planarization uniformity across a single wafer. During the pad conditioning process, a pad conditioner with an abrasive surface is forced to come in contact with the working surface of the pad while both the pad and the conditioner move at pre-determined speeds and pressure. While the operation of conditioning is an effective way of deterring the wear of the polishing pad, the pad requires replacement when either its surface conditions are not recovered by conditioning or its thickness drops below a pre-determined level.

The pad conditioning can be done, for example, with a conditioning device described in U.S. Pat. No. 5,486,131 issued in January 1996 to Cesna, et al. The conditioner has an either circular or ring configuration and is provided with a combination of vertical motion, rotation around a vertical axis, and oscillating horizontal movement.

To ensure good pad flatness during the above conditioning process, the U.S. Pat. No. 5,868,605 issued in February 1999 to Cesna, suggests supplying both pad and conditioner with oscillating radial motions, with a stroke of reciprocation sufficient to have the conditioner extending over the edges of the polishing pad.

Another way of conditioning with optimum pad shape is suggested in the U.S. Pat. No. 5,941,761 issued in August 1999 to Nagahara, et al. A rigid end effector is attached to the above-mentioned conditioner with a concave region to produce a dome-like pad shape.

The above three conditioning methods do not monitor the conditioning process, which dramatically reduces their accuracy. A process operator does not receive any information on when to stop conditioning in order to avoid excessive pad wear, when to replace the conditioner or the pad, and how to adjust the polishing process depending on the state of the pad, thus risking to lose the quality of polishing.

Pad conditioning can be performed both in-situ, that is, during and simultaneously with polishing, and ex-situ, that is, before the polishing. In either case, there is a need for continuous monitoring the pad surface condition in order to make the following decisions:

a—how to adjust the conditioning process to achieve the best pad performance, b—when to accelerate (if there is insufficient conditioning) or decelerate (if there is excessive pad wearing) the in-situ conditioning, c—when to stop polishing for ex-situ conditioning, d—when the pad is worn out to such extent that additional conditioning would be useless and the pad has to be replaced, e—when the conditioner is either worn or contaminated, and so requires either replacement or cleaning, correspondingly.

An example of conditioning control is described in U.S. Pat. No. 5,951,370 issued in September 1999 to Cesna. Pad thickness is monitored with laser elements at the inner and outer pad diameters, and compared. If it fluctuates substantially, a control signal is produced, which causes an appropriate adjustment movement of the conditioner to ensure the target flatness of the pad. This method controls pad flatness, but does not monitor any other crucial characteristics of pad wear and surface condition.

Another example of the conditioning control is given in U.S. Pat. No. 5,975,994 issued in November 1999 to Sandhu, et al. It suggests monitoring the distribution over the pad surface of such its characteristics as thickness of wear debris and other polishing waster and pad contour, and then selectively conditioning only the non-uniform areas of the pad surface. The selective conditioning is achieved, for instance, by changing the down-force and speed of the conditioner over various pad areas. This method controls pad flatness and, to a lesser degree, surface cleanliness, but it does not address other crucial characteristics of pad wear and surface condition.

A method and apparatus for measuring the thickness loss of a polishing pad is described in the U.S. Pat. No. 6,354,910 issued in March 2002 to R. Adebanjo et al.

The method uses rigid planar members placed on the surfaces of both the conditioned and non-conditioned sections of the polishing pad. Measurements are made utilizing measurement tools, which overhang the depressed conditioned section, and measure actually the height difference between the upper surfaces of the planar members. This method provides information about pad thickness in just several pre-determined locations rather than over the whole working area, and also does not monitor the pad surface condition.

A single sensor for pad control is suggested in the U.S. Pat. No. 6,040,244 issued in March 2000 to Arai, et al. This sensor scans the pad before and after polishing, simultaneously measuring pad thickness and contour, as well as its surface roughness. This method, however, does not provide for in-situ, in-process pad control.

By nature, the removal of material during both polishing and conditioning is caused by surface interactions or friction. Both polishing and conditioning processes to a great extent depend on such factors as friction characteristics of the materials, surface conditions of the wafer, conditioner and the polishing pad, the rate of wear of the polishing pad, and the rate of removal of the wafer material. Thus, for control and optimization of polishing processes, it is necessary to experimentally monitor the wear and friction characteristics of polishing pads in real time and actual polishing conditions.

An attempt of a friction-based CMP process control based on measuring the running motor current is described in U.S. Pat. No. 5,948,700 issued in September 1999 to Zheng, et al. This technique is not applicable for accurate measurements of forces and torques and for polishing process control. Since no load current flows through the electric motor when no load is applied thereto, it is difficult to accurately detect the level of friction developed on the platen. Furthermore, the current flowing through the motor greatly depends on the voltage of corresponding power supply and on speed of rotation. Therefore even small variations in the power supply voltage and changes in the rotation speed cause significant changes in the current. In addition, since in the aforementioned CMP system both the platen and the wafer holding device are connected to respective motors through corresponding transmissions, accuracy of friction measurements based on the motor current may be affected by losses and slippage in the transmissions.

A method and apparatus for controlling a polishing process described in U.S. Pat. No. 5,738,562 issued on Apr. 14, 1998 to Doan, et al. are based on measurement of variations that occur in translational (lateral) motions of the polishing platen, related to the variations in friction of different film materials. These method and apparatus are based on indirect measurement technique, result in very approximate evaluation of the friction variations, cannot accurately measure the friction coefficients and thus, are not suitable for practical control of the CMP process. Also, they do not measure pad wear.

Another polishing control method is disclosed in U.S. Pat. No. 5,948,205, issued in September 1999 to Kodera, et al. It comprises steps of measuring friction between the layer being polished and a turntable carrying a polishing slurry during polishing, determining the polishing rate from the measured friction, determining the extent of polishing by integrating the polishing rate over time, and terminating the polishing operation when the measured polishing extent coincides with a predetermined value. This method assumes that the friction and the rate of polishing are in direct relationship, which is not typically a fact. Also, it monitors neither a pad conditioning process nor pad wear.

An apparatus and a method for conditioning monitoring in CMP are disclosed in WO Patent No. 01/15865 A1, issued in March 2001 to Moore. A CMP machine contains a conditioner attached to a support and a force sensor connected to the conditioner support for measuring a friction force in the interface between the conditioner and a polishing pad. The apparatus allows for monitoring the conditioning process. However, the frictional force can be a function of the surface characteristics of the pad and conditioner, as well as a function of the normal compression force and the relative velocity between the two surfaces. Also, this method does not monitor pad wear. Additionally, this apparatus is complicated and expensive, as the force sensor has to be integrated in the conditioner assembly.

A method of polishing pad control is described in U.S. Pat. Nos. 5,650,619 and 5,825,028, issued to Hudson in July 1997 and October 1998, correspondingly. It is based on covering the pad with a special indicating compound and detecting defective pads by changes in the compound. Though this method may allow for separation of good and bad polishing pads, it is not applicable for in-situ conditioning and pad wear control.

Another method of pad conditioning control is suggested in U.S. Pat. No. 6,234,868, issued in May 2001 to Easter, et al. It consists of the load control via a magnetic mechanism. Though this method may allow for pad conditioning, it does not have any feedback on pad surface conditions and wear, which limits its accuracy and usefulness.

Two U.S. Patents issued to Robinson, et al., U.S. Pat. No. 6,090,475 of July 2000 and No. 6,136,043 of October 2000, suggest a polishing pad, which changes its color when worn out. This may allow for detection of the time of plate replacement, though it makes the pad more expensive. This technique, however, allows to monitor neither dynamics of pad wear nor any crucial pad surface conditions.

A method of pad conditioning control is described in U.S. Pat. No. 5,664,987, issued in September 1997 to Renteln. It includes measurements of the removal rate on just polished wafers and comparison of the measured data with a predetermined level. When the removal rate drops below this level, the pad is conditioned. Though providing a rather common way of conditioning control, this method lacks immediate, real-time feedback for adjusting the conditioning process, and as a result, one or several wafers may be under-polished or over-polished before the pad is optimally conditioned. Also, it does not indicate when the pad is worn out and has to be replaced.

An apparatus for polishing pad contour monitoring, which measures the contour of a polishing surface of the pad, is disclosed in U.S. Pat. No. 5,618,447 issued in April 1997 to Sandhu. The monitor consists of a displacement sensor, which is attached to a supporting member assembled rigidly over the pad. The sensor has a vertical guide and a sliding pin on its working tip, continuously sliding on the rotating pad and thus measuring the pad contour. This apparatus may be sufficient to characterize pad contour and wear, but it does not address any other important conditions of a pad surface, directly affecting polishing results.

A similar apparatus for in-process pad control is described in U.S. Pat. No 5,834,645 issued in November 1998 to Bartels, et al. A contact probe interrogates the pad and generates a control signal when the measured displacement of its contact stylus exceeds a pre-selected threshold, thus indicating the presence of an extraneous material. The probe can have an angular or translational motion and may include plurality of optical fibers. This apparatus may be sufficient to characterize pad contamination, but it does not address pad wear and other important conditions of a pad surface, directly affecting polishing results.

A non-contact pad control is suggested in U.S. Pat. No. 6,045,434 issued in April 2000 to Fisher, et al. The non-contact interferometry measurements of pad thickness and wear are conducted either during or between polishing cycles, with the measured data used as a feedback signal for both polishing and pad conditioning control. Either ultrasound or electromagnetic radiation transmitters and receivers are aligned to cover the full radial length of the pad. This method may be sufficient, though expensive, to characterize pad wear, but it does not monitor any other important conditions of a pad surface, directly affecting polishing results.

A similar pad control is described in U.S. Pat. No. 6,194,231, issued in February 2001 to Ho-Cheng, et al. A radial pad profile is monitored with a linearly scanning device, and when the profile change exceeds a predetermined limit, the pad has to be changed. Again, this method may be sufficient, though expensive, to characterize pad wear, but it does not monitor any other important conditions of a pad surface, directly affecting polishing results.

A pad conditioning control suggested in U.S. Pat. No. 6,093,080 issued in July 2000 to Inaba, et ale is based on measurements of either a frictional force between the pad and wafer or a corresponding torque current. The conditioning process is adjusted so as to make the frictional force in polishing constant; these adjustments can be done in conditioning load, time or number of conditioner revolutions. This method may allow for process control, but it has several drawbacks. Firstly, it does not monitor pad wear. Secondly, it may be too complicated and expensive to measure the polishing friction force between pad and wafer. Thirdly, as will be shown later in the text, frictional force is not a so stable process characteristic as the coefficient of friction. Lastly, monitoring torque current may not be accurate due to the effects of friction in bearings, transmission and other components of the mechanical system of the polishing apparatus.

The U.S. Pat. No. 6,257,953 issued to N. Gitis et al. in July 2001, as well as U.S. U.S. Pat. No. 6,494,765 issued to the same authors in December 2002 provides an apparatus and a method for monitoring the polishing and conditioning processes using coefficient of friction sensors and acoustic emission sensors, and performing direct monitoring of both pad-wafer and pad-conditioner interfaces. However, these methods and apparatuses have the sensors and signal electronics built into the polishing machine, which is complicated and expensive. Also, they do not monitor pad wear.

The above described methods and apparatuses do not combine measurements of pad wear with frictional or acoustic parameters, and as a result, cannot be effectively used in semiconductor production for making process decisions by separating different process problems. Indeed, if measuring Pad friction or acoustics alone, when the friction or acoustic parameter deviates out of process specification, the operator has insufficient information to distinguish whether it is due to a worn pad which has to be replaced, or to a worn conditioner which has to be either cleaned or replaced, or to a defective incoming wafer. Similarly, if measuring pad wear alone, the operator cannot wait for replacing the pad when wear has reached a critical depth, as it is common when polishing uniformity and removal rate deteriorate much earlier than when the critical Pad wear death has been reached. Therefore, a demand for more accurate and comprehensive control of pad conditioning by monitoring pad wear and its surface condition still exists, as the known methods and apparatus do not provide full control and comprehensive measurements of pad surface conditions inherent in a polishing process

OBJECTS OF THE INVENTION

It is an object of the present invention to provide effective, accurate, universal, and reliable method and apparatus for monitoring polishing plate condition and wear and thus control of a plate conditioning process in polishing. Another object is to provide an apparatus for monitoring polishing plate condition as a separate unit, which does not require changes in a polishing machine and is capable to monitor condition of a polishing plate currently installed on the polishing machine. Another object is to provide method and apparatus for monitoring polishing plate conditions and wear and thus to control a polishing process, including a CMP process, by differentiating process problems. It is another object to provide a method and apparatus for polishing plate monitoring on the basis of combined direct wear, frictional and acoustical measurements. It is another object to provide an inexpensive, easy to use, aforementioned apparatus of the type that can be built into any polishing, grinding, or lapping machine without need in structural modification of such a machine. Yet another object is to provide an apparatus and method for a CMP process with controlled conditioning of the polishing plate surface.

BRIEF SUMMARY OF THE INVENTION

The invention provides an apparatus and a method for monitoring a polishing plate condition, capable of simultaneous measurements of compression and friction forces, acoustic emission signal developed in contact between special probes and a polishing plate, as well as polishing plate wear, which is a result of both polishing and conditioning procedures. The apparatus is not a part of a machine the polishing plate is installed on, though can be attached to it in order to monitor condition of a currently installed polishing plate. The apparatus comprises a measuring unit, being in contact with the polishing plate, and a data processing unit. The measuring unit contains a set of sensors, which can include wear sensors, friction force sensors, compression force sensors, and acoustic emission sensors. The sensors measure compression force, friction force, acoustic emission level, and wear of a polishing plate. The data processing unit acquires the data signals from the measuring unit and computes process parameters, such as friction coefficient, wear rate, etc. The apparatus makes it possible to monitor the condition of the polishing plate surface, affecting the polishing, and to detect the moment when the plate needs to be replaced.

Additionally, the invention provides the aforementioned apparatus and method, wherein the sensors are installed on both a working zone of a polishing plate surface and its non-working zone. This method allows for monitoring the condition of the working zone of the polishing plate in comparison with its non-working zone.

BRIEF DESCRIPTION OF THE DRAWINGS

FIG. 11 part c is a graph of a detected acoustic signal generated between the polishing plate and the probing tip, versus time during polishing.

FIG. 11*d* is a typical graph of a removal rate during polishing

DETAILED DESCRIPTION OF THE INVENTION

The applicants have found that control and optimization of polishing based only on friction force or friction torque measurements are not accurate enough to satisfy requirements for example, of modern semiconductor fabrication. A much more important parameter, characterizing properties of contacting materials and degree of their interaction, is a coefficient of friction (COF) or friction coefficient, which is a ratio of a friction force between two surfaces to a force compressing these surfaces in perpendicular direction.

Figure 1A:
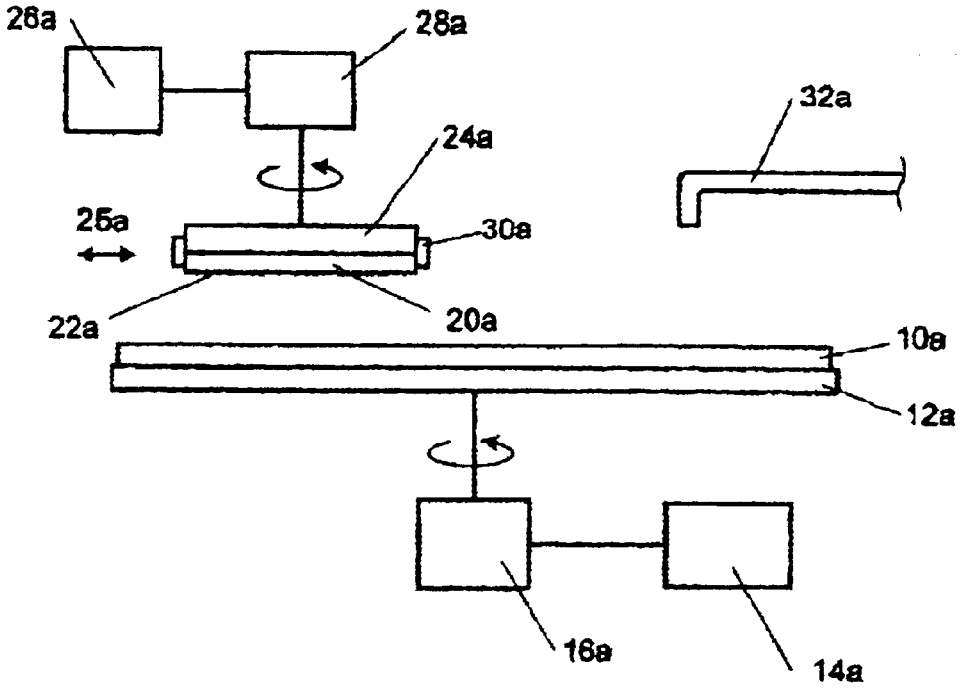
Fig. 1a. Prior Art
FIGS. 1A and 1B are schematic views of known polishing apparatuses with a rotating plate.
Figure 1B:
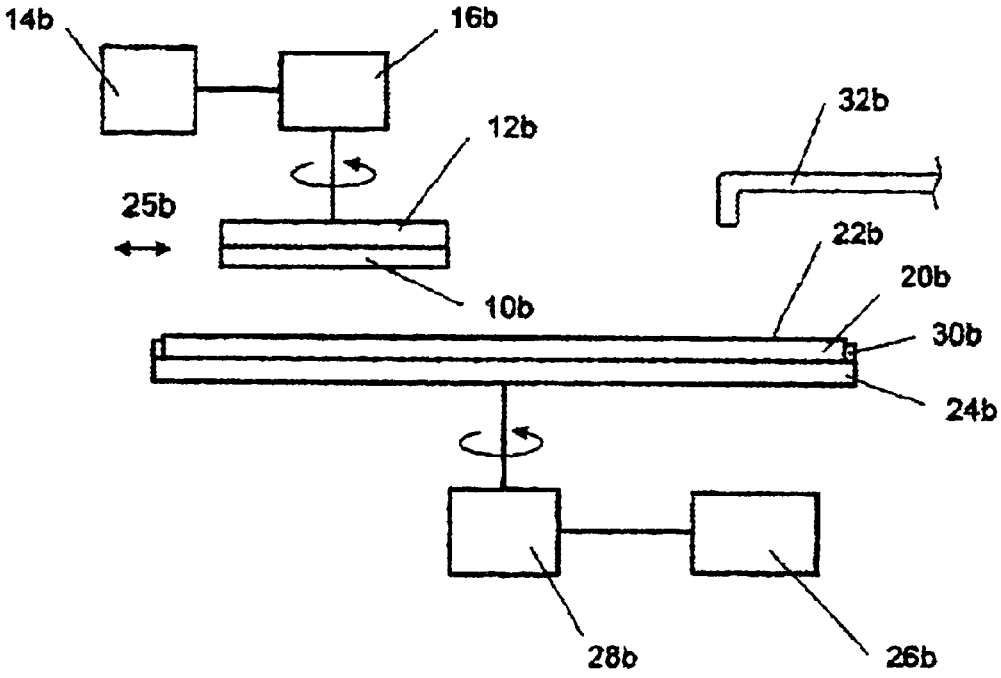
Fig. 1b. Prior Art
Figure 2:
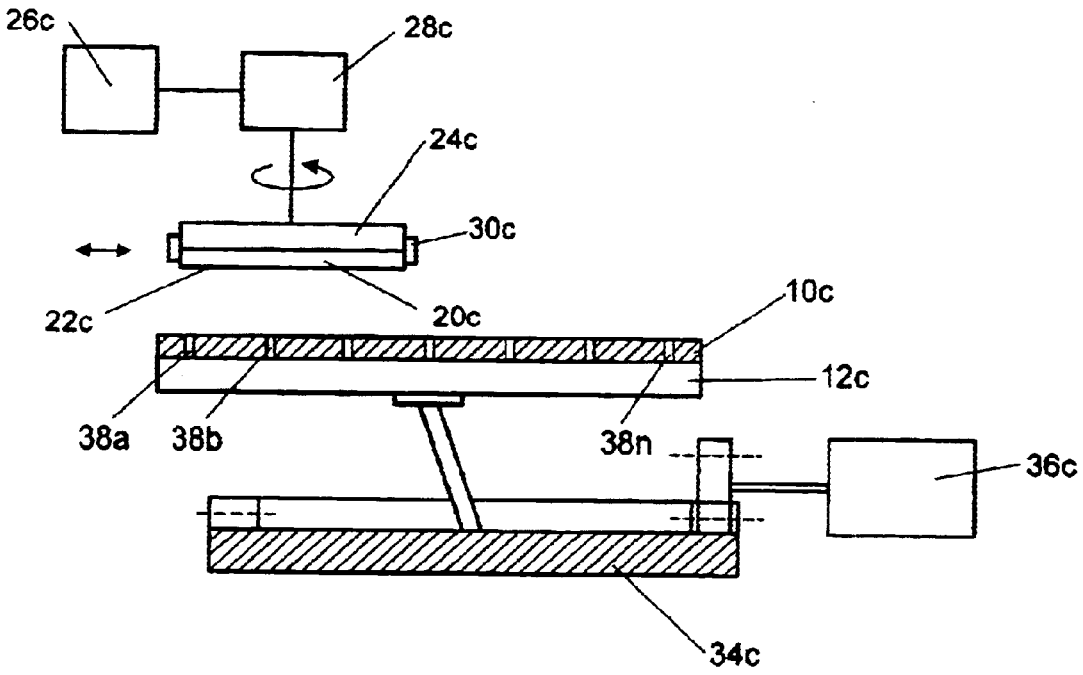
Fig. 2. Prior Art
FIG. 2 is a schematic view of a known polishing apparatus with an orbital plate.
Figure 3:
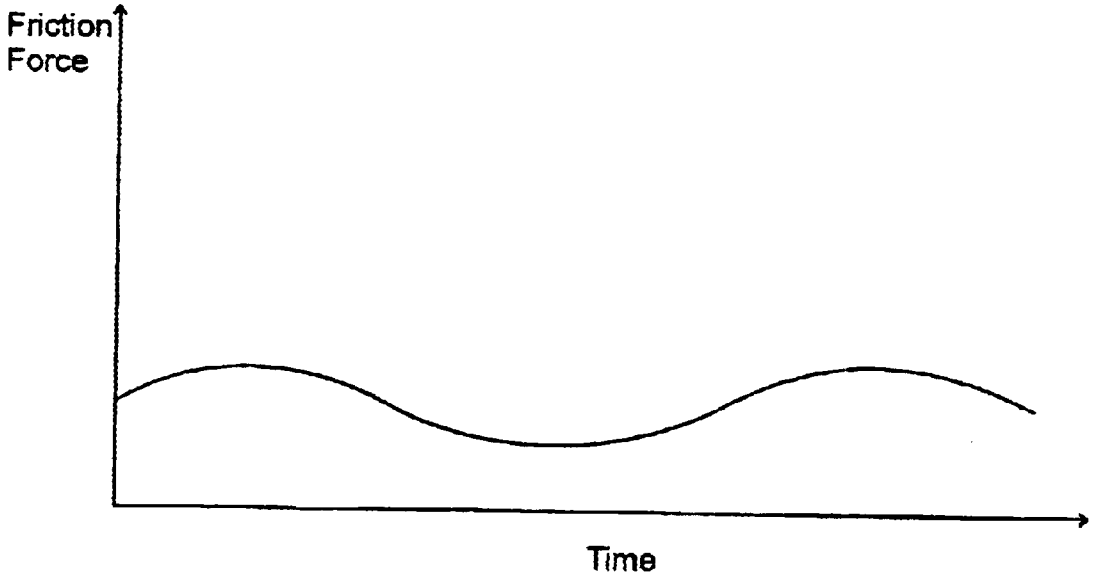
FIG. 3 is a graph of a friction force versus time.
Figure 4:
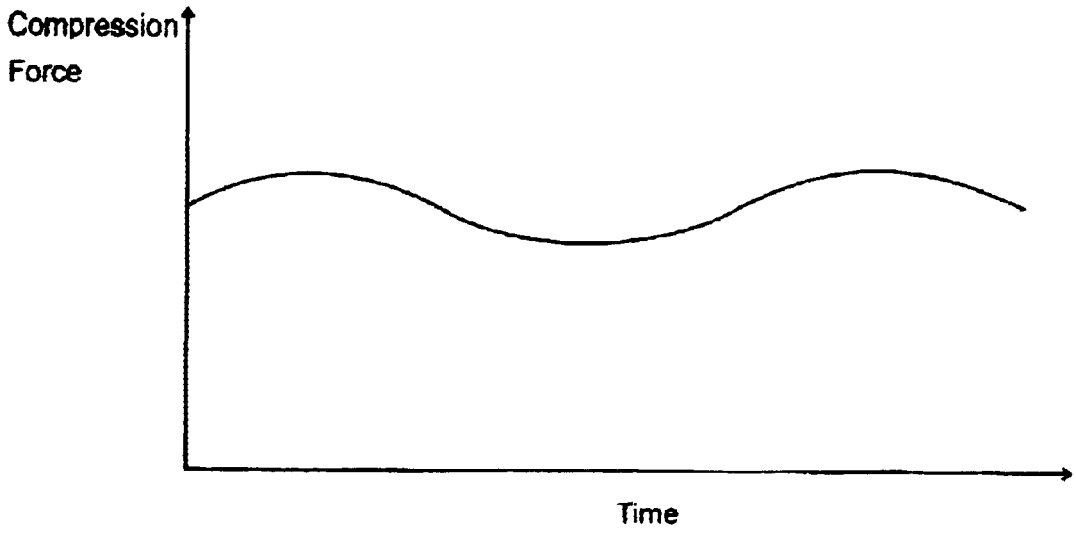
FIG. 4 is a graph of a compression force versus time.
Figure 5:
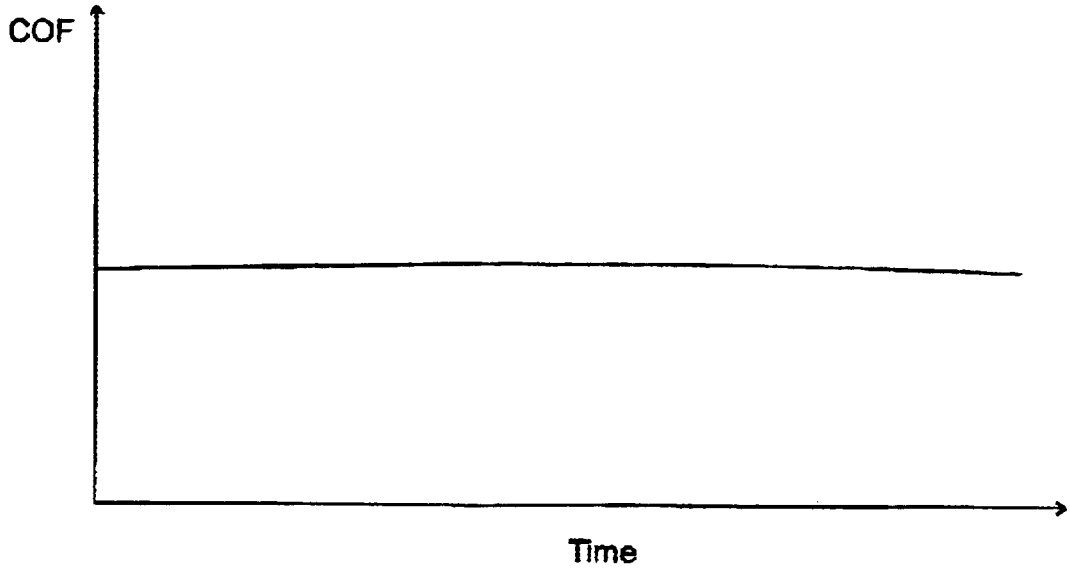
FIG. 5 is a graph of a friction coefficient versus time.

The above statement can be explained with reference to FIG. 3, which is a graph illustrating typical behavior of a friction force measured on a polishing plate. Significant variations in the friction force can be related not only to changes in friction properties of the plate, but also to variations in the normal force. FIG. 4 shows the behavior of the normal force, which also oscillates (e.g., due to runout or non-flatness of a plate, or instability of a loading mechanism), while the friction coefficient, shown in FIG. 5, remains constant. Thus, by measuring the friction force alone, without the normal compression force, one can come to a false conclusion.

Another important characteristic of the polishing process that can be used for effective control of polishing is a high-frequency acoustic emission signal, which represents elastic waves generated in the interface between the contacting surfaces and propagating through contacting parts. The amplitude and frequency spectrum of an acoustic emission signal depend on hardness, density and other mechanical properties of interacting parts and on intensity of surface interactions. Since generation of elastic waves is associated with interactions between small features on the contacting surfaces of the interacting parts, the acoustic signal generated during such interactions has a high frequency (typically 100 kHz to 10 MHz).

Figure 6:
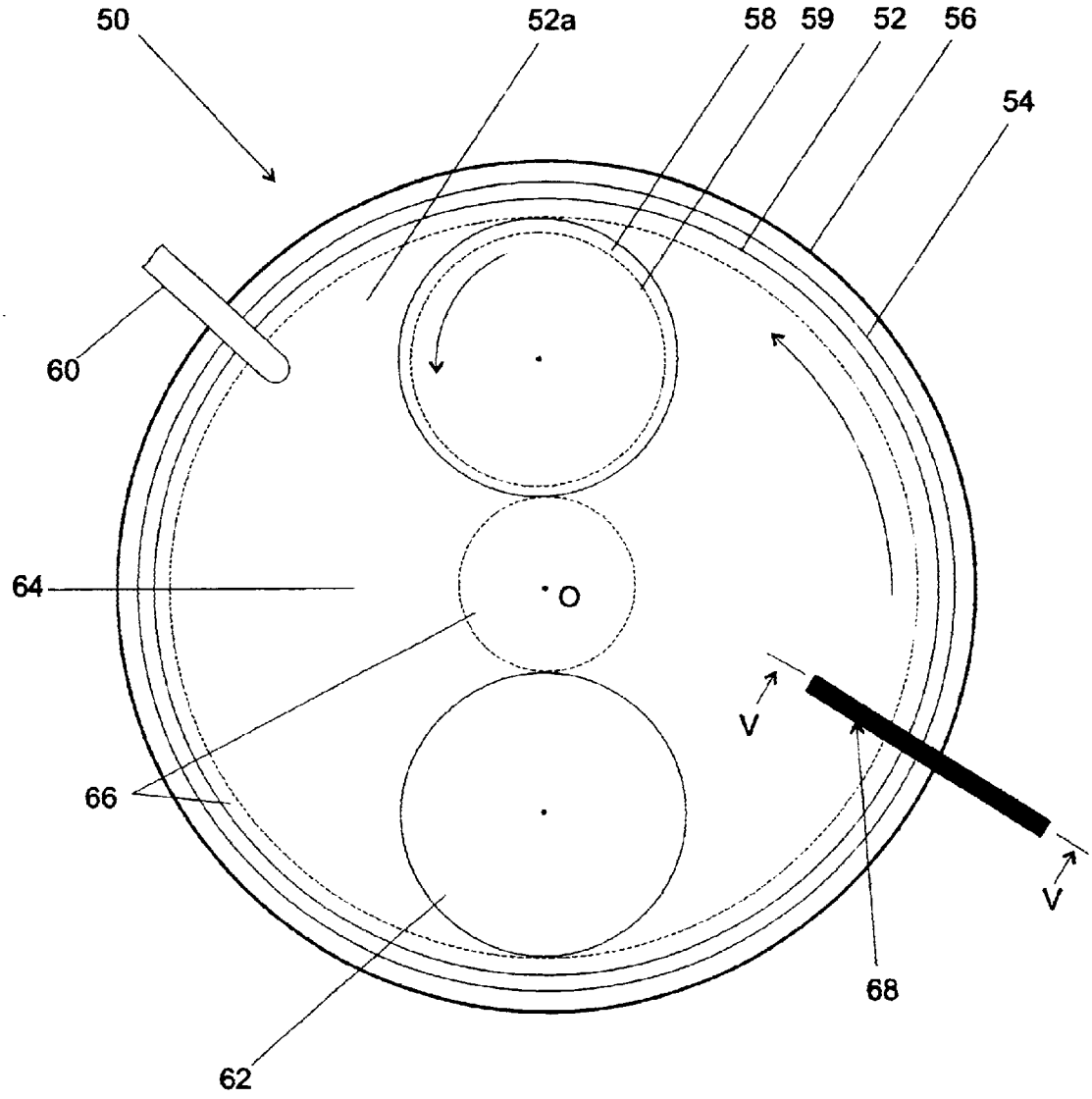
FIG. 6 is a schematic view of an apparatus of invention with one fixed measuring unit

Schematic top view of the apparatus of the present invention installed on a typical polishing machine is shown in FIG. 6 and is designated by reference 50. A polishing plate 52 is attached to a metal platen 54, which can move relative to a frame 56. During polishing, the platen 54 with the plate 52 are rotated around a vertical axis O, perpendicular to the drawing, while the frame 56 stays stationary. The lower surface of a polished object 59 (not seen in the FIG. 6) in a polishing head 58 is pressed against the plate working surface 52*a*. During polishing it is common that both platen 54 with the plate 52 and head 58 with the polished object 59 are moving, for example, rotating and providing frictional frictional contact between the working surface 52*a* and the front surface of the polished object 59, thus performing the polishing. During the process the pipeline 60 is supplying polishing slurry onto the plate 52 to facilitate the object polishing. A conditioning unit 62 with its abrasive surface, not seen in FIG. 6, is pressed against the working surface 52*a*. The conditioning unit 62 refreshes the surface 52*a*, removing the upper layer of it, therefore decreasing the thickness of the polishing plate 52. As seen in the FIG. 6, the working surface 52*a* consists of two regions. The annular region 64 is directly involved into the polishing and conditioning procedures (working zone), while the outermost narrow annular region and the central circular area form a non-working zone 66 (separated from a working zone 64 with a dotted line in FIG. 6), which is not changed during polishing.

Figure 7:
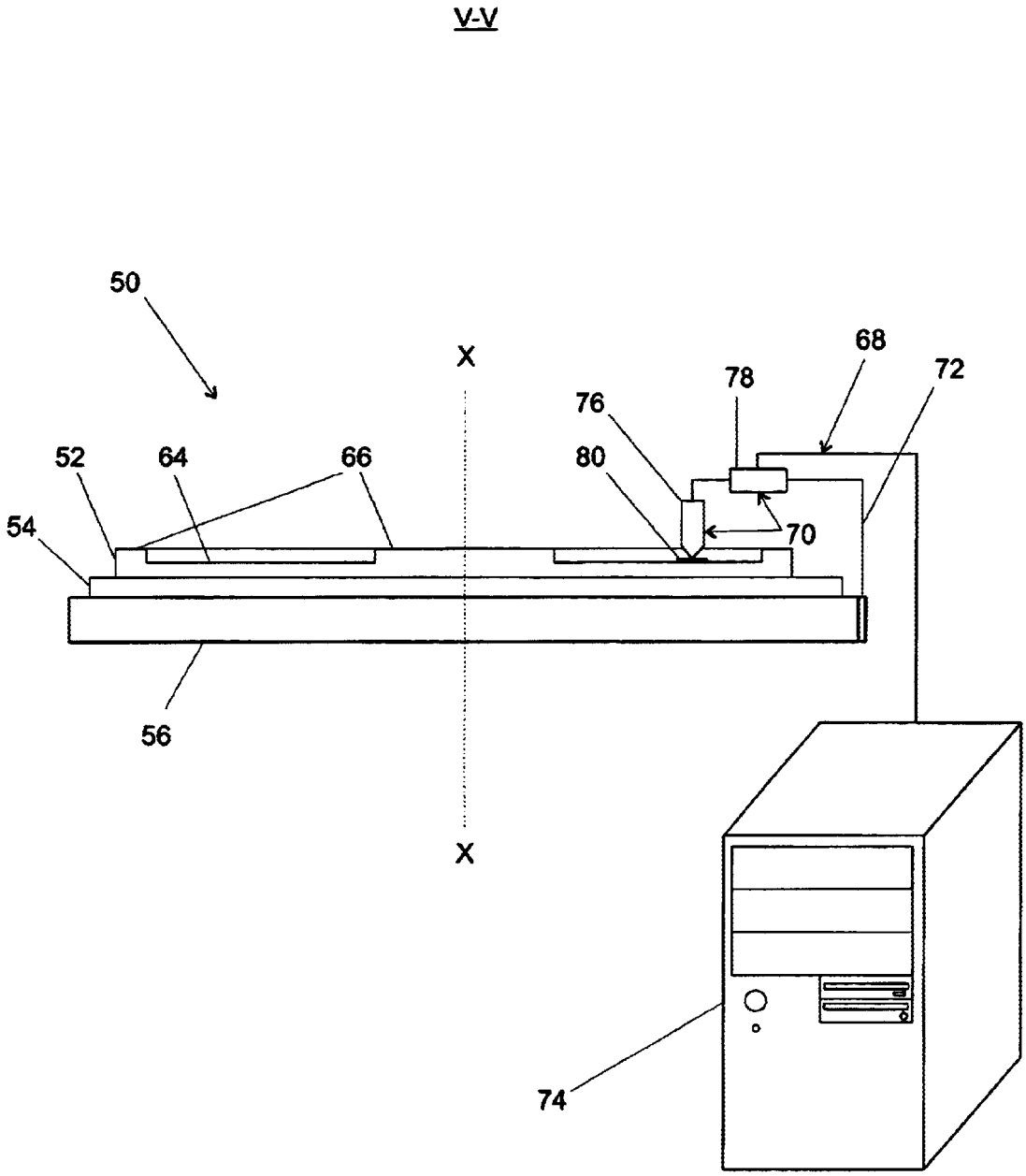
FIG. 7 is a cross-sectional view of the apparatus in FIG. 6

Reference number 68 in FIGS. 6, 7 designates the apparatus of this invention, attached to the frame 56 of the polishing machine. FIG. 7 presents a vertical cross-sectional view along the line V-V. The apparatus 68 includes a measuring unit 70, a bracket 72 for attaching the measuring unit 70 to the frame 56, and a data processing unit 74. The measuring unit in tum, comprises a sensing unit 76, and a signal-conditioning unit 78. The sensing unit 76 includes a special low-friction non abrasive probing tip 80 and a set of sensors. The set of sensors can contain an acoustic emission (below referred to as AE) sensor, compression force and friction force dual sensor (further referred to as a COF-sensor), and a wear sensor. The normal pressure applied to the probing tip 80 (typically lower than 0.5 psi) is much less than the normal pressure applied to the polished object 59 in the polishing head 58, but is sufficient to maintain the probing tip 80 in a contact with the polishing plate 52.

The probing tip 80 is designed to minimize its effects on polishing plate 52. It is typically small (two inches or less) to reduce its adhesion/stiction to the working surface 52*a*, has dull edges not to scratch the plate, and is made either from low-friction materials or the same material as the polished object 59. Its front surface is smooth and durable, with stable physical and mechanical characteristics.

In this embodiment, the measuring unit 70 is stationary, while the polishing plate 52 is moving.

The signals from the sensing unit 76 are conditioned with a signal-conditioning unit 78 and then are sent to the data processing unit 74.

Figure 8:
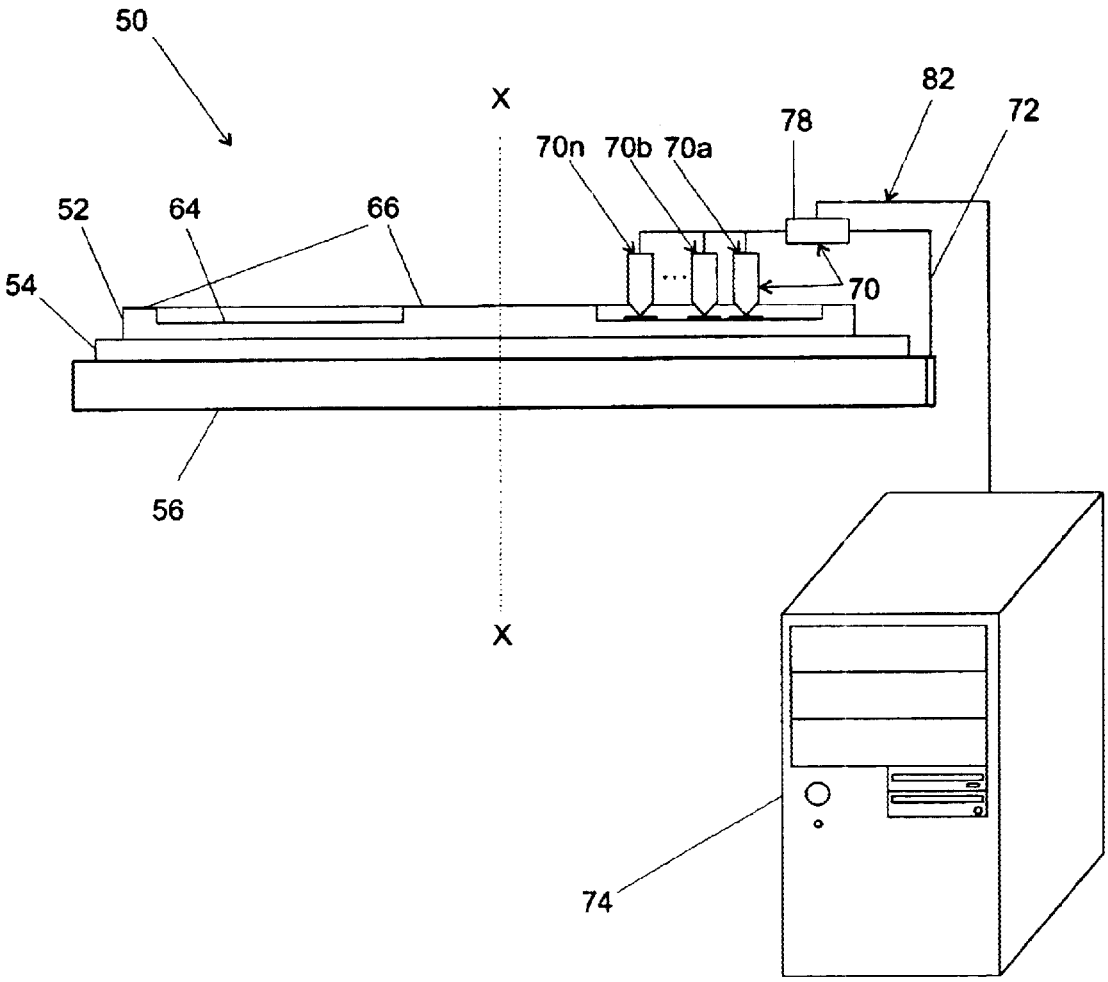
FIG. 8 is schematic view of an apparatus of invention with more than one fixed measuring unit

In another embodiment of the presented invention shown in FIG.8, the apparatus 82 contains more than one measuring unit 70*a*, 70*b* . . . 70*n*, placed on different plate radii. This design allows for measuring the above-described signals at the different radii of the polishing plate. This makes it possible for the data processing unit to determine the uniformity of the polishing plate surface, and to adjust the conditioning process in order to keep the working surface 52*a* uniform all over the working zone 64.

In this embodiment, the measuring units 70*a*, 70*b* . . . 70*n* are preferably stationary, while the polishing plate 52 is moving relative to them, either rotary or linearly or orbitally.

Figure 9:
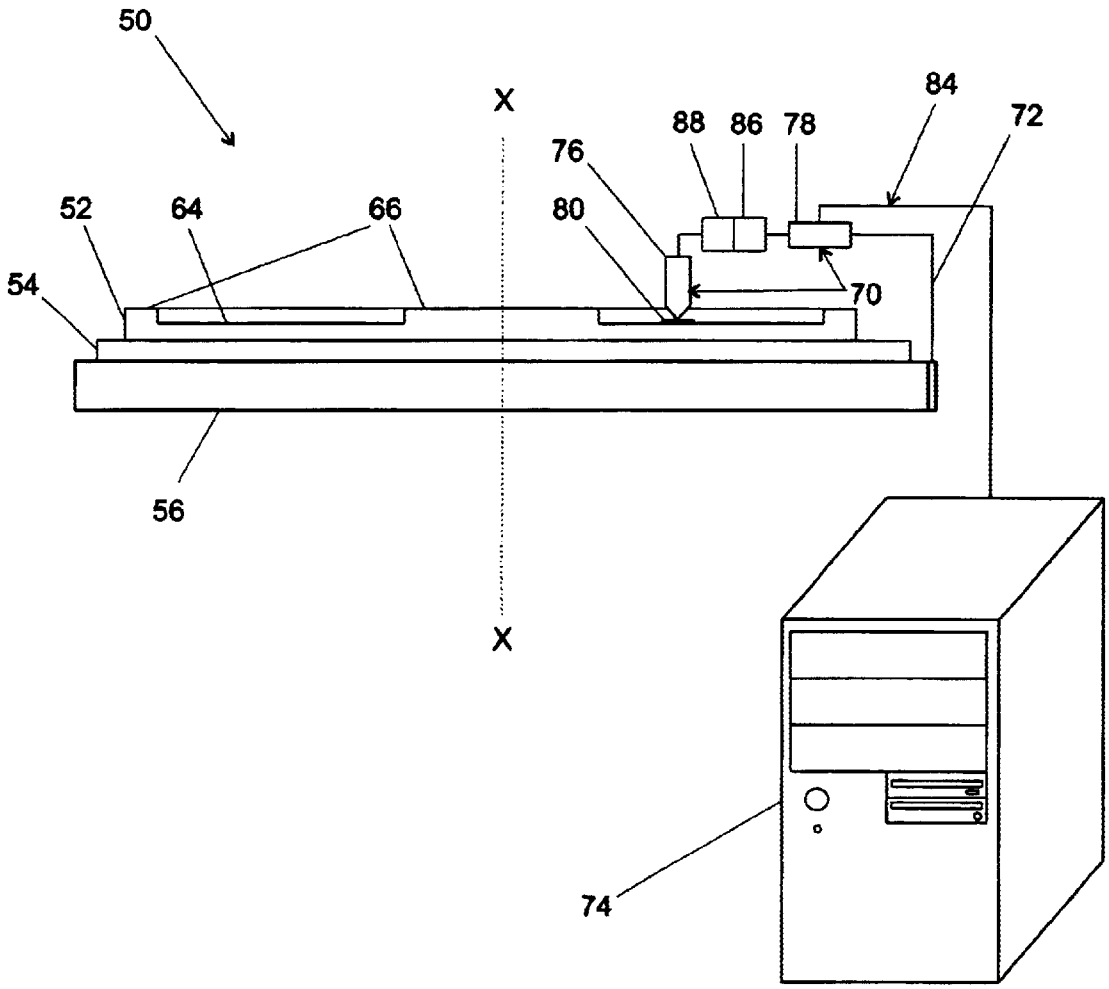
FIG. 9 is a schematic view of an apparatus of invention with one movable measuring unit

Yet another embodiment of the presented invention is shown in FIG. 9. The apparatus of invention 84 contains a positioning sensor 86, measuring the position of the measuring unit 70 on the bracket 72, and an actuator 88, which can move the measuring unit 70 along the plate radius, allowing to perform measurements on virtually all working zone 64. The actuator 88 is also connected to the data processing unit 74, so that in this embodiment processing unit 74 controls the measuring unit position.

In this embodiment both the measuring unit 70 and the polishing plate 52 move, with the former one having preferably linear motion and the latter one having either rotary or linear or orbital motion. Also, the measuring unit 70 can be moved in the direction, substantially perpendicular to the working surface 52*a* to bring its probing tip 80 in contact with the polishing plate 52 on some discrete areas of the working surface 52*a*.

Figure 10:
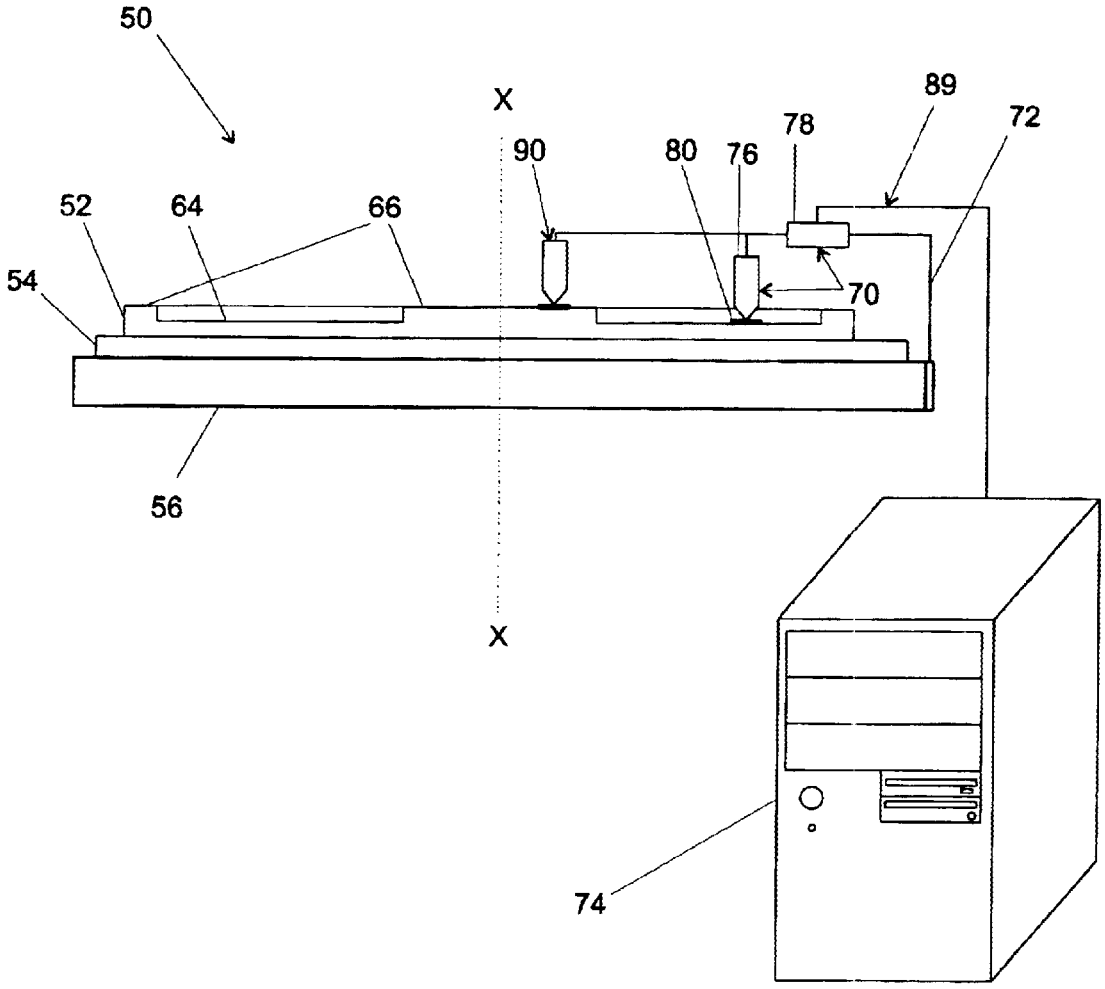
FIG. 10 is a schematic view of an apparatus of invention with more than one fixed measuring unit one of which is installed over the non-working surface of a polishing pad FIG. 11 part a is a graph of wear of a polishing plate versus time during polishing.

The next embodiment of the invention is shown in FIG. 10 and is designated with a number 89. It contains a reference measuring unit 90, installed on the non-working zone 66 of the polishing plate. The reference measuring unit 90 is similar to the measuring unit 70. Signals from the reference measuring unit 90 create a reference level, which can be used by the data processing unit 74 for more precise plate wear detection and pad surface condition monitoring.

In this embodiment the reference measuring unit 90 is preferably stationary, the polishing plate 52 can have either rotary or linear or orbital motion. The measuring unit 70 can be either stationary or moving along the polishing plate 52.

During polishing the front surface of the polished object 59 is brought into contact with the working surface 52*a* of the polishing plate 52 mounted on the platen 54. The head 58 supporting the object 59 rotates around its center and at the same time can perform radial motions relative to the center of the platen 54, around the vertical axis X-X (FIG. 7). The platen 54 at the same time moves relative to the object 59, e.g. rotates in respect to the axis X-X or performs orbital or linear motions. Motion of the platen 54 with the plate 52 relative to the polishing object 59 provides for polishing.

During polishing the working surface 52*a* of the polishing plate 52 collects particles removed from the polished object 59, as well as polishing slurry, and becomes clogged, gradually losing its polishing characteristics. In order to maintain the desired quality of polishing and polishing removal rate, the working surface 52*a* has to be conditioned. A conditioning head 62, shown in FIG. 6, can perform pad conditioning either during polishing (in-situ) or between polishing cycles (in-situ or ex-situ). During conditioning the abrasive surface of the conditioning head 62 removes the upper layer of the polishing plate 52, exposing its non-clogged surface and preparing it for performing the quality polishing. As the polishing plate 52 has a limited thickness, after removal of the predefined amount of its material it loses its polishing characteristics, cannot be properly reconditioned again, and has to be replaced.

The probing tip 80 of a sensing unit 76 is brought into the contact with the working surface 52*a* of the polishing plate 52. The apparatus 68 provides sufficient compression force to maintain a contact between the lower surface of the probing tip 80 and the working surface 52*a*. As a result friction force is acting in a direction parallel to the above-mentioned surfaces. This friction force depends on the compression force provided, as well as on the state of contacting surfaces. The sensing unit 76 may contain at least one of the earlier-mentioned sensors, for example, only COF, or only AE, or only wear sensor. For the more comprehensive monitoring it may have at least two sensors, for example, the wear sensor to characterize the durability of polishing plate 52, and an either COF or AE sensor to monitor the current condition of this plate. The most comprehensive monitoring of the polishing plate 52 is achieved by using all of the three described sensors.

The COF sensor, being a part of the sensing unit 76, provides the means of acquiring both compression force and friction force. These two forces are used in a data processing unit to calculate a coefficient of friction, reflecting the actual condition of the working surface 52*a*. The acoustic emission sensor, also in the sensing unit 76, detects an acoustic signal, generated at the contacting surfaces of the probing tip 80 and polishing plate 52. This signal can also be used as a characteristic of the actual condition of the working surface 52*a*. The wear sensor in the sensing unit 76 detects polishing plate wear. Based upon the wear signal, the data processing unit can make conclusions about the polishing plate condition and time to replace the plate.

All above-mentioned sensors are connected to the signal-conditioning unit 78. This unit can detect, amplify, filter the data signals from the sensors; in other words, it can perform all necessary signal conditioning. Conditioned signals from the output of the signal-conditioning unit 78 are sent to the data processing unit 74.

The data processing unit 74 comprises an analyzer, e.g., data analysis hardware and software for retrieving and analyzing conditioned data signals and calculating the polishing parameters according to predetermined algorithms. If necessary it can contain a control subsystem, e.g. motor controller for controlling the operation of the apparatus of the embodiment shown in FIG. 9.

Figure 11:
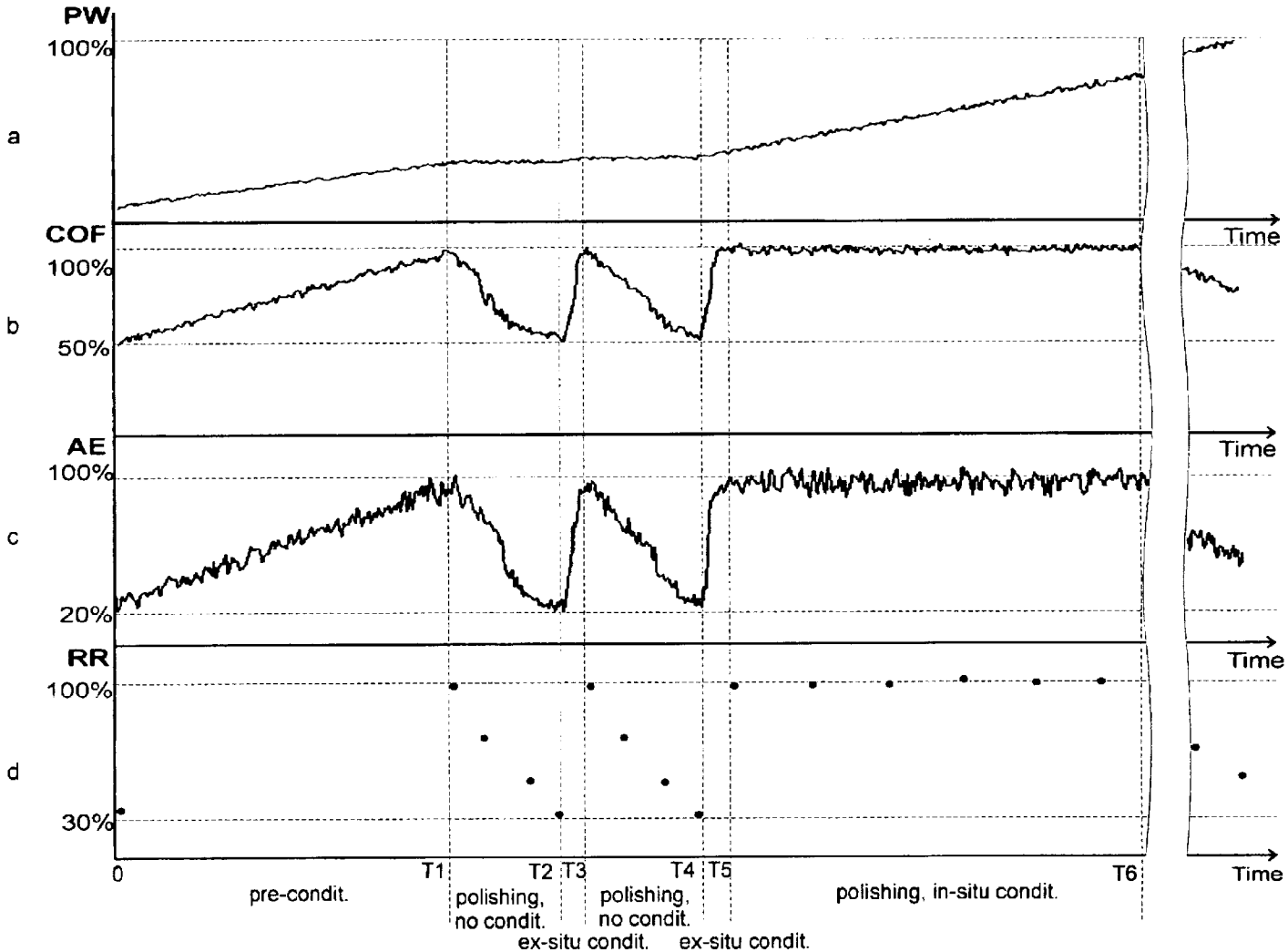
FIG. 11 part b is a graph of a coefficient of friction between the polishing plate and the probing tip, versus time during polishing.

FIG. 11(*a*)–(*c*) represents graphs, illustrating typical changes in polishing plate wear (FIG. 11(*a*)); coefficient of friction (FIG. 11(b)); and acoustic emission signal (FIG. 11(*c*)), with time, observed with the apparatus and method of this invention.

An initial portion of the graph from the beginning moment 0 to moment T1 on the time scale corresponds to the pre-conditioning of a just-installed plate, when the working surface 52*a* is conditioned with the abrasive surface of the conditioning unit 62 (FIG. 6). During this procedure, the plate wear grows (FIG. 11(*a*)) with the material removal, the COF and AE increase and reach their optimal working levels, designated as 100%, in FIG. 11(*b*), and 11(*c*) correspondingly. The second portion of the graphs from T1 to T2, as well as the portion between moments T3 and T4, corresponds to polishing procedures, not accompanied with in-situ conditioning. During these periods of time the working surface 52*a* gets clogged with the particles removed from the polished object, and gradually loses its quality, but not thickness. Therefore, the wear stays substantially constant (FIG. 11(*a*)), the COF gradually drops to the level close to 50% of the optimal working level (FIG. 11(*b*)), and AE signal decreases more dramatically (FIG. 11(*c*)), to about 20% of its maximal level. The next ex-situ conditioning procedures (moments T2 to T3 and T4 to T5 on the time scale) restore the polishing properties of the polishing plate 52, so that all corresponding areas on graphs in FIG. 11 are similar to the described above for the interval 0 to T1. Thus, with time wear increases during every conditioning procedure, while COF and AE signals rise during conditioning and then fall down during polishing.

The next procedure reflected in the graph, which refers to a time period T5 to T6, is a polishing process, performed in parallel with in-situ conditioning. During this period of time wear continues to grow, as seen in FIG. 11(*a*), while COF and AE signals stay about constant (FIG. 11(*b*), 11(*c*)), which indicates the uniformity of the polishing procedure.

When the polishing plate 52 is worn out, the conditioning cannot bring its surface back to the optimal working condition. This is denoted in FIG. 11(*a*) with a 100% wear level, or the critical wear level, when the polishing plate has to be replaced. This wearing out can be seen in FIG. 11(*b*) and 11(*c*), when both COF and AE levels gradually decrease despite continuous conditioning. This is also a good indication of the polishing plate being worn out and in need of replacement.

FIG. 11(*d*) reflects how the polishing removal rate (RR on the chart) of the polished object changes in the course of the above described polishing and conditioning periods. The removal rate measurements are performed ex-situ and represented with dots. The plate condition defines the removal rate (for the given combination of materials and process parameters), with the latter increasing when plate is conditioned and decreasing when the plate loses its quality during polishing.

It can be seen that the data measured with the apparatus of this invention per the invented method shown in FIGS. 11*a* to 11*c*, have very good correspondence with the removal rate, which is the most important characteristic of polishing.

Thus, it has been shown that the invention provides an effective, accurate, universal reliable method and apparatus for monitoring the condition of a polishing plate during mechanical or chemical mechanical polishing. The method and apparatus of the invention allow for monitoring the condition of a polishing plate on the basis of real-time direct frictional, acoustical, and wear measurements, making the decision of process adjustments and polishing plate replacement timely and optimal. Indeed, when monitoring a combination of either pad friction or acoustics with pad wear, deviation of the friction or acoustic parameter out of the process specification while accompanied by high pad wear is reflective of the worn pad which has to be replaced, while accompanied by low pad wear can reflect either a worn conditioner which has to be cleaned or replaced, or a defective incoming wafer. Further combining both friction and acoustic measurements, the case of low pad wear can be separated into the case of worn conditioner and the case of defective incoming wafers. Similarly, when monitoring pad wear with either friction or acoustic signals, the high wear reflective of a worn pad may put the operator in a stand-by attentive mode so that to replace the pad as soon as an either friction or acoustic parameter deteriorates.

The invention has been shown and described with reference to specific embodiments which should be construed only as examples and do not limit the scope of practical applications of the invention. Therefore any changes and modifications in materials, shapes, diagrams and their components are possible, provided these changes and modifications do not depart from the scope of the patent claims. For example this invention can be used to monitor the tool condition during grinding, lapping, milling, and other kinds of the surface finishing using any type of abrasive finishing tool. The apparatus of the invention can be used not only for process monitoring, but also to perform an automatic control of polishing in order to maintain its parameters and quality. The apparatus of this invention can be implemented both as a part of the polishing apparatus and a standalone device; it can be in contact with the monitored plate surface or brought in contact with it periodically—using automatic means or manually. It can contain additional sensors, e.g. temperature, laser displacement, electrical, etc. in order to provide better monitoring of the polishing plate surface. It can contain a signal module, creating an alert signal for personnel when a polishing plate requires replacement. It can contain an additional control module to control an automatic plate-replacing unit. The method of this invention can use a single apparatus of the invention with multiple polishing plates. The apparatus can have a bracket for rigid attachment of its parts to each other or the apparatus as a whole to the polishing machine or a standalone base.

What is claimed is:

1. An apparatus for monitoring a condition of a polishing plate used for polishing an object, said polishing plate having a working surface, said apparatus comprising;

a measuring unit, comprising at least one sensing unit and a signal-conditioning unit, and a data processing unit;

said at least one sensing unit being in contact with said polishing plate configured for relative movement between said at least one sensing unit and said polishing plate, said at least one sensing unit comprising a probing tip having a front surface and a back surface, said front surface of said probing tip being in contact with said working surface of said polishing pate; and a set of sensors generating data signals, said set of sensors being attached to said back surface of said probing tip, and contains a wear sensor for generating plate wear data signal corresponding to wear of said polishing plate; and at least one sensor from the group, consisting of a coefficient of friction sensor, comprising compression sensing means for generating compression data signal corresponding to compression force between said probing tip and said polishing plate, and friction sensing means for generating friction data signal corresponding to friction force between said probing tip and said working surface of said polishing plate; and an acoustic emission sensor, for generating acoustic data signal corresponding to acoustic emission generated between said working surface of said polishing plate and said front surface of said probing tip;

said signal-conditioning unit comprising means for acquiring said data signals and generating conditioned signals;

said data processing unit being electrically connected to said signal-conditioning unit and comprising means for acquiring and processing said conditioned signals.

2. The apparatus of claim 1, additionally comprising a positioning sensor means, for determining a position of said probing tip of each of said at least one sensing unit on said working surface of said polishing plate, and an actuator means for moving said probing tip of each of said at least one sensing unit relative to said polishing plate in a direction parallel to said working surface.

3. The apparatus of claim 2, wherein said working surface of said polishing plate comprises a working zone, which is used to polish said object, and a non-working zone, not used for polishing; said measuring unit comprises at least one sensing unit, being in contact with said working zone of said working surface, and at least one sensing unit, being in contact with said non-working zone of said working surface.

4. The apparatus of claim 1, wherein said working surface of said polishing plate comprises a working zone, which is used to polish said object, and a non-working zone, not used for polishing; said measuring unit comprises at least one sensing unit, being in contact with said working zone of said working surface, and at least one sensing unit, being in contact with said non-working zone of said working surface.

5. A method for monitoring a condition of polishing plate having a working surface and used for polishing an object, having a polished surface, said method comprising the steps of:

i) providing an apparatus for monitoring a condition of the polishing plate, comprising a measuring unit, said measuring unit comprising at least one sensing unit and a signal-conditioning unit; and a data processing unit; said at least one sensing unit sensing unit being in contact with said polishing plate configured for relative movement between said at least one sensing unit and said polishing plate, said at least one sensing unit comprising a probing tip having a front surface, and a set of sensors generating data singles, said set of sensors being attached to said probing tip and contains a wear sensor and at least one sensor from the group, consisting of a coefficient of friction sensor and an acoustic emission sensor; said signal condition unit comprising means for acquiring said data signals and generating conditioned signals; said data processing unit being electrically connected to said signal-conditioning unit and comprising means for acquiring and processing of said conditioned signals;

ii) bringing said front surface of said probing tip of each of said at least one sensing unit in contact with said working surface of said polishing plate in contact areas;

iii) sensing condition of said working surface of said polishing plate in said contact areas by means of said at least one sensing unit;

iv) conditioning said data signals form said contact areas by means of said signal-conditioning unit, and measuring and processing said conditioned signals by means of said data processing unit;

v) computing values of at least two parameters, one of a wear parameter and at least one from a set of parameters, consisting of a coefficient of friction parameter and an acoustic emission parameter, characterizing said condition of said polishing plate in said contact areas, using said conditioned signals, by means of said data processing unit; and vi) making a decision about said condition of said polishing plate based upon said steps of sensing, conditioning, and processing.

6. The method of claim 5, wherein said step of providing an apparatus for monitoring a condition of the polishing plate further comprises providing a positioning sensor means, for determining the position of said probing tip of each of said at least one sensing unit on said working surface of said polishing plate, and an actuator means for moving said probing tip of each of said at least one sensing unit relative to said polishing plate in a direction parallel to said working surface;

said method further comprising the following steps between said step v) and vi):

vii) moving said at least one sensing unit using said positioning sensor means, and said actuator means and bringing said front surface of said probing tip of each of said at least one sensing unit in contact with said working surface of said polishing plate in next contact areas;

viii) sensing condition of said working surface of said polishing plate in said next contact areas by means of said at least one sensing unit;

ix) conditioning said data signals form said next contact areas by means of said signal-conditioning unit, measuring and processing of said conditioned signals by means of said data processing unit;

x) computing values of at least two parameters, one of a wear parameter and at least one from a set of parameters, consisting of a coefficient of friction parameter and an acoustic emission parameter, characterizing said condition of said polishing plate in said next contact areas, using said conditioned signals, by means of said data processing unit; and xi) repeating the steps vii)–x) if necessary.

7. The method of claim 6, wherein said step of providing an apparatus for monitoring a condition of polishing plate further comprises:

providing a polishing machine, capable of performing a polishing process over said object with removing material from said polished surface of said object; and polishing said object on said polishing machine.

8. The method of claim 7, wherein said value of at least one of said coefficient of friction parameter and said acoustic emission parameter has an optimal level;

said method further comprising a step of producing a notification signal by said data processing unit for said polishing, when said value of at least two parameters comprising at least one of said coefficient of friction parameter and said acoustic emission parameter differs from said optimal level.

9. The method of claim 7, wherein said value of said wear parameter has a critical level;

said method further comprising a step of producing a notification signal by said data processing unit for said polishing, when said value of at least two parameters comprising said wear parameter reaches said critical level.

10. The method of claim 9, further comprising a step of producing control signals for controlling said polishing in response to said step of computing.

11. The method of claim 8, further comprising a step of producing control signals for controlling said polishing in response to said step of computing.

12. The method of claim 5, wherein said step working surface of said polishing plate having a working zone, used to polish said object, and a non-working zone, not used for polishing;

wherein said step of sensing condition of said working surface further comprises sensing condition on said working zone and on said non-working zone;

said method further comprising a step of comparing said values of said at least two parameters from said working zone and form said non-working zone.

13. The method of claim 12, wherein said step of providing an apparatus for monitoring a condition of polishing plate further comprises:

providing a polishing machine, capable of performing a polishing process over said object with removing material from said polished surface of said object; and polishing said object on said polishing machine.

14. The method of claim 13, wherein said value of at least one of said coefficient of friction parameter and said acoustic emission parameter has an optimal level;

said method further comprising a step of producing a notification signal by said data processing unit for said polishing, when said value of at least two parameters comprising at least one of said coefficient of friction parameter and said acoustic emission parameter differs from said optimal level.

15. The method of claim 13, wherein said value of said wear parameter has a critical level;

said method further comprising a step of producing a notification signal by said data processing unit for said polishing, when said value of at least two parameters comprising said wear parameter reaches said critical level.

16. The method of claim 15, further comprising a step of producing control signals for controlling said polishing in response to said step of computing.

17. The method of claim 14, further comprising a step of producing control signals for controlling said polishing in response to said step of computing.

18. The method of claim 5, wherein said step of providing an apparatus for monitoring a condition of polishing plate further comprises:

providing a polishing machine, capable of performing a polishing process over said object with removing material from said polished surface of said object; and polishing said object on said polishing machine.

19. The method of claim 18, wherein said value of at least one of said coefficient of friction parameter and said acoustic emission parameter has an optimal level;

said method further comprising a step of producing a notification signal by said data processing unit for said polishing, when said value of at least two parameters comprising at least one of said coefficient of friction parameter and said acoustic emission parameter differs from said optimal level.

20. The method of claim 19, further comprising a step of producing control signals for controlling said polishing in response to said step of computing.

21. The method of claim 18, wherein said value of said wear parameter has a critical level;

said method further comprising a step of producing a notification signal by said data processing unit for said polishing, when said value of at least two parameters comprising said wear parameter reaches said critical level.

22. The method of claim 21, further comprising a step of producing control signals for controlling said polishing in response to said step of computing.

* * * * *